US005281072A

United States Patent [19]

Patouillard et al.

[11] Patent Number: 5,281,072

[45] Date of Patent: Jan. 25, 1994

[54] WAGON FOR CARRYING A LIFTING CRADLE AND A CRADLE THEREFOR

[75] Inventors: Jean-Baptiste Patouillard, Villars; Paul Fanget, Saint-Etienne; Jean-Louis Chevalier, Veauche, all of France

[73] Assignee: Marrel, Boutheon, France

[21] Appl. No.: 869,258

[22] Filed: Apr. 15, 1992

[30] Foreign Application Priority Data

Apr. 19, 1991 [FR] France ..... 91 04867

[51] Int. Cl.[5] ..... B65G 67/00

[52] U.S. Cl. ..... 414/349; 105/355; 105/455; 414/333; 414/345; 414/498

[58] Field of Search ..... 414/333, 345, 349, 498; 105/455, 355, 278.1

[56] References Cited

U.S. PATENT DOCUMENTS

| | | | |
|---|---|---|---|
| 1,968,196 | 7/1934 | Francis | 414/333 |
| 2,933,052 | 4/1960 | Mellam | 414/333 X |
| 3,352,438 | 11/1967 | Davidson | 414/333 |
| 3,516,368 | 6/1970 | Wright | 105/455 |
| 3,884,158 | 5/1975 | Rumell | 105/455 X |
| 3,916,799 | 11/1975 | Smith | 414/333 X |
| 4,129,079 | 12/1978 | Shannon | 414/345 X |

FOREIGN PATENT DOCUMENTS

| | | |
|---|---|---|
| 3607307 | 9/1987 | Fed. Rep. of Germany . |
| 1512592 | 2/1968 | France . |
| 1213324 | 11/1970 | United Kingdom . |
| 2108473 | 5/1983 | United Kingdom . |

*Primary Examiner*—David A. Bucci
*Attorney, Agent, or Firm*—Remy J. VanOphem

[57] ABSTRACT

A wagon for carrying a lifting cradle having a wagon chassis and at least one pivotable body mounted to pivot about an axis for pivoting and guides for receiving at least one lifting cradle. Components for locking the lifting cradle to the chassis include a shaft fixed to the chassis and disposed along the vertical axis for pivoting, two attachment arms disposed on either side of a longitudinal plane of symmetry and mounted on the shaft to pivot between an unlocking configuration and a locking configuration, the arms including noses projecting laterally each adapted, in the locking configuration, to engage between two substantially transverse sides of a housing provided on the side beams of the lifting cradle and, in the unlocked configuration, to be outside the housings. Elements to control and guide the movement of the arms and to block the arms in the locked configuration are attached to the arms.

21 Claims, 11 Drawing Sheets

84
82
85
80

XII
XII
XIII
XIII
80
83
85
84
81
65
84
85
82

80
83
84
84
82

96
97
95
98
94A
94
99
18
22
XIX
XVIII

WAGON FOR CARRYING A LIFTING CRADLE AND A CRADLE THEREFOR

BACKGROUND OF THE INVENTION

The invention relates to a wagon for carrying a lifting cradle and particularly to the manner of locking in position a load provided with such a lifting cradle, for example a skip, platform, container or the like, on a wagon equipped with pivoting loading structures.

In order to allow movement of a load provided with a lifting cradle between a lorry equipped with a loading-/unloading arm and a wagon, it is known to provide on the wagon a rectangular horizontal body connected to the wagon by an articulation having a vertical axis located in the longitudinal plane of symmetry of the wagon and in the longitudinal vertical plane of symmetry of the body, near one of the ends of the body.

In order to load or unload a lifting cradle on the wagon the body must be pivoted laterally to the side where the lorry is located until the body is aligned with the chassis of the lorry. The transfer of the load between the body and the lorry is then performed by maneuvering the loading/unloading arm of the lorry.

If required, conventional means are employed to ensure the compatibility of the height of the chassis of the lorry and of the body.

It should be recalled that the term "lifting cradle" refers to the interfacing elements required to allow the loading/unloading of a load by means of a loading/unloading arm. A lifting cradle principally includes two longitudinal beams, each having at one end a vertical extension at the top of which a holding bar or ring is provided which is adapted to become engaged with the lifting hook of a loading/unloading arm. To this lifting cradle (which is sometimes called a cradle skeleton) is fixed in practice by welding, bolting or the like, the load support proper (plate, box, etc.).

When a lifting cradle is loaded onto a pivotable body from a lorry, the body is brought into alignment with the wagon and the problem which arises is then to lock it in position.

For this purpose it has been arranged to fix to the ends of the longitudinal beams of the body, near which the articulation is mounted, U-shaped stops adapted to receive and arrest rear rollers mounted conventionally on the rear end of the longitudinal beams of the lifting cradle. These stops are adapted to resist unwanted longitudinal forces or forces directed vertically upwards. When the body is brought into alignment with the wagon, the front ends of the longitudinal beams of the lifting cradle (to which the aforementioned vertical extension is fixed) are brought opposite stopping elements fixed to the wagon. In a first embodiment these stopping elements are fixed buffers adapted to resist any longitudinal sliding of the lifting cradle in their direction without any possibility of arresting them if unintended lifting forces occur. In a second embodiment these stopping elements are hooks which become engaged with lateral projections provided at the front of the lifting cradle which are adapted to resist unintended longitudinal or lifting forces.

It is pointed out that the French and European safety standards generally require that the different aforementioned stopping elements must withstand, in the case of accidental collisions, accelerations which may be as large as 4 g.

Despite their merits the aforementioned solutions to the problem have various disadvantages, including in particular the following. When shocks due to stopping are applied to the U-shaped stops provided on the longitudinal beams of the body, all the unwanted forces pass through the intermediary of the body, with consequent risks of damage to the body and to the body/wagon articulation. The sets of stops can only be used for one length of lifting cradle, which means that different wagons must be provided for each type of lifting cradle. Further, it is not possible to load lifting cradles onto the bodies from above.

The object of the invention is to alleviate the aforementioned disadvantages by making it possible to hold, on the body of a wagon, lifting cradles having different lengths, with the wagon directly absorbing the unwanted longitudinal forces in both directions and any lifting forces which might be accidentally applied to the lifting cradles or to the load to which they are fixed, while allowing loading of the lifting cradles from above, without requiring any substantial modifications to the standard geometry of the lifting cradles and with the possibility of adapting existing lifting cradles.

SUMMARY OF THE INVENTION

For this purpose the invention proposes a wagon for carrying a lifting cradle having a wagon chassis and at least one substantially horizontally arranged pivotable body mounted to pivot relative to the wagon chassis about an upwardly extending pivoting axis. The pivotable body includes guides for receiving at least one lifting cradle which are elongate members. The wagon further includes locking means for locking the lifting cradle to the wagon chassis which has a shaft fixed to the wagon chassis and disposed along the pivoting axis. First and second attachment arms are mounted on the shaft to pivot between an unlocked configuration and a locked configuration, each attachment arm including a lateral projection adapted, in the locked configuration, to engage between two substantially transverse sides of a housing provided on the elongate members of the lifting cradle and, in the unlocked configuration, to be outside the housing. Means for controlling and guiding the movement of the attachment arms and means for holding the attachment arms in the locked configuration are also provided.

Preferably the wagon chassis is adapted to roll on rails. The pivoting axis can extend in a longitudinal plane of symmetry of the wagon so that the attachment arms extend on either side of the plane of symmetry.

Preferred embodiments of the invention provide the following features which can be used singly or in combination.

The lateral projections on the attachment arms are orientated in opposite directions to one another, the locked configuration being a configuration in which these projections are spaced apart and the unlocked configuration being a configuration in which these projections are close together.

The shaft on which the attachment arms are pivotably mounted extends through a rolling ring connecting the body to the chassis.

The pivoting axis is located near one end of the body and the arms extend from the shaft towards the other end of the body.

The arms include, beneath the lateral projections, vertical projections each adapted, in the locked configuration, to engage beneath a track forming part of the receiving guides and designed to support the elongate members of the lifting cradle.

The projections of the attachment arms each have an inside edge adapted to be orientated, in the locked configuration, at a right angle relative to the instantaneous longitudinal plane of symmetry of the arms and an outside edge perpendicular to a line connecting the edge to the pivoting axis.

The angle between the sides of the housings is at least approximately equal to 60°.

The means for controlling and guiding the movement of the arms are a guide fixed to the pivotable body and disposed parallel to the elongate members of a cradle supported by the body, between them and equidistant from them, a slide mounted to slide on the guide between two longitudinal positions, and two rods articulated, respectively, on the slide and on the arms. Means for controlling the movement of the slide on the guide are also provided.

The rods are substantially aligned with one another in the locked configuration.

The means for controlling the movement of the slide is a manual control lever pivotably mounted at its middle on the slide about a vertical finger and extending transversely to the pivotable body. The two ends of the lever are engaged in two horizontal slots defined in parallel vertical plates fixed to the pivotable body and equipped with an arresting hook for blocking the ends of the lever in one or the other of the ends of the slots. The ends of the slots closest to the pivoting axis, called the internal ends, are disposed in such a manner that, when the ends of the lever are positioned there, the arms are in the locked configuration. The slots extend longitudinally over a distance such that when the lever has one end in the opposite end of the other slot, the arms are in the unlocked configuration and the slide bears against a stop on the pivotable body. The stop is a crossbeam equipped with a set of rollers. The vertical finger is inserted between two facing guide bearings fixed to the chassis and extending parallel to the longitudinal plane of symmetry. The guide bearings form part of two curved elements fixed to the chassis and having concave surfaces for guiding in rotation centered on the pivoting axis and designed so that the vertical finger is alongside them when the body pivots and the arms are in the locked configuration.

The control means include a vertical finger projecting downwards and engaged in a curved groove extending on either side of the longitudinal plane of symmetry with a median portion closer to the pivoting axis than its end portion. The groove is disposed on the chassis in such a manner that the attachment arms are in the locked configuration when the vertical finger is in the median portion and are in the unlocked configuration when the finger is in the extreme end portions, as a result of which the movement of the arms between the locked and unlocked configurations is caused by the pivoting of the body relative to the chassis.

The attachment arms are disposed between the pivoting axis and the set of rollers carried by a crossbeam of the body and by means of which the body rolls on the chassis.

The chassis includes elements for preventing rotation of the ends of the elongate members of the body furthest from the axis for pivoting and the chassis may also be composed of three pivotable bodies.

Further objects, characteristics and advantages of the invention will emerge from the following description, given by way of example only, with reference to the attached drawings.

DETAILED DESCRIPTION OF THE PREFERRED EMBODIMENT

Figures 1, 2:
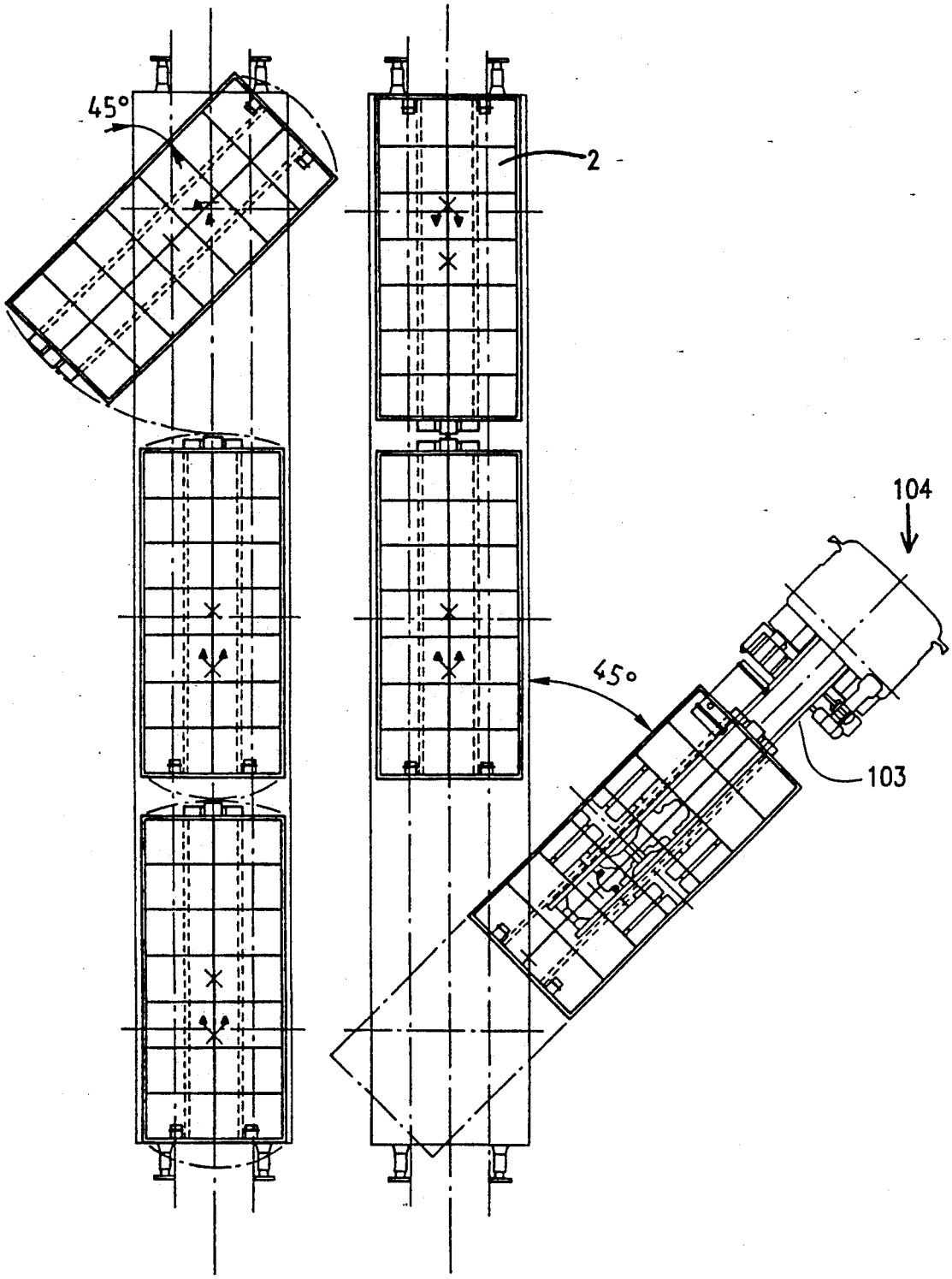
FIG. 1 is a schematic view from above of a wagon composed of three pivotable bodies one of which (shown in chain dotted lines) is in the course of being loaded.
FIG. 2 is another schematic view of the wagon from above wherein a different body is turned laterally.
Figure 3:
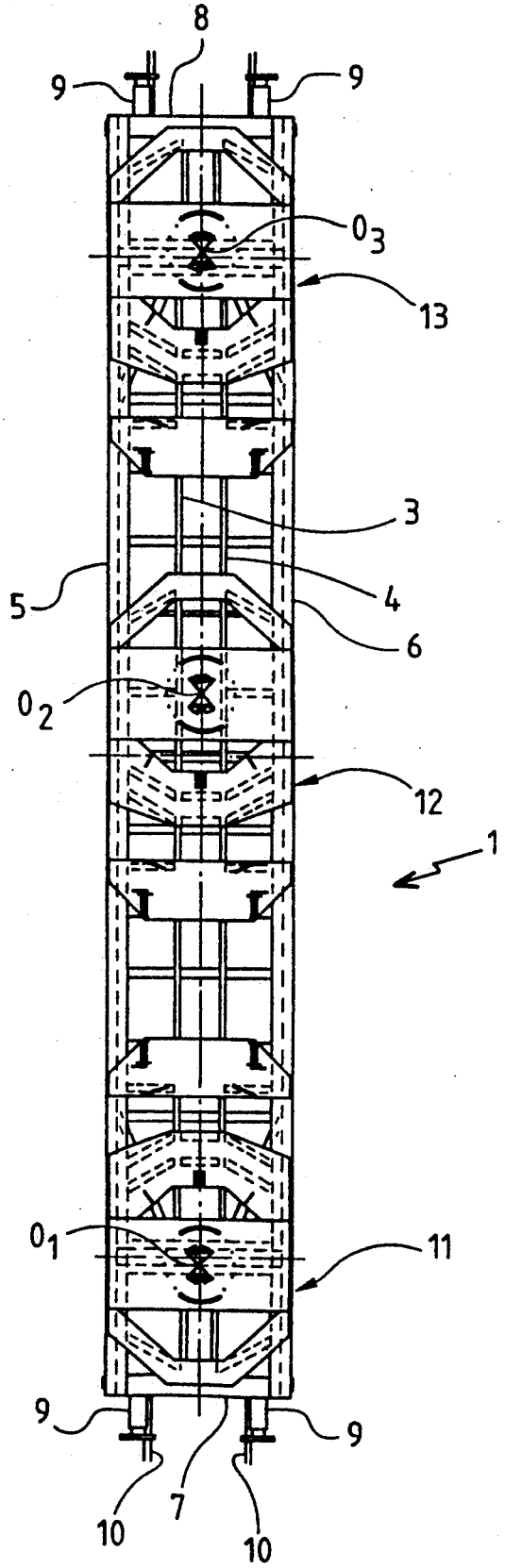
FIG. 3 is a view of the wagon without the bodies.

FIGS. 1 and 3 show a railway wagon 1 equipped with three pivotable bodies 2 each adapted to receive a lifting cradle having a length equal to or less than the length of the bodies. In this case there are three bodies per wagon but this number can be changed, for example, to two or even four.

In this case the length of the wagon is 18.66 m and each body is 5.70 m long.

Each body is fixed to the chassis of the wagon by an articulated joint having a vertical axis $0_1$, $0_2$ or $0_3$, located in a longitudinal plane of symmetry of the wagon and in a longitudinal plane of symmetry of the body near one end of the body (in this case 1.94 m from the end).

In FIG. 1, one of the bodies is turned laterally through 45° so as to be in alignment, at least as seen from above, with the chassis 103 of a lorry 104 equipped with a loading/unloading arm of any appropriate known type (not shown), for example of the type described in French Patent FR-2,185,520 belonging to the applicant.

In FIG. 2 it is the body at the other end which is turned through 45° to the other side in such a manner that FIGS. 1 and 2 also be interpreted as showing two similar wagons on two adjacent tracks in the course of being loaded simultaneously.

Figure 4:
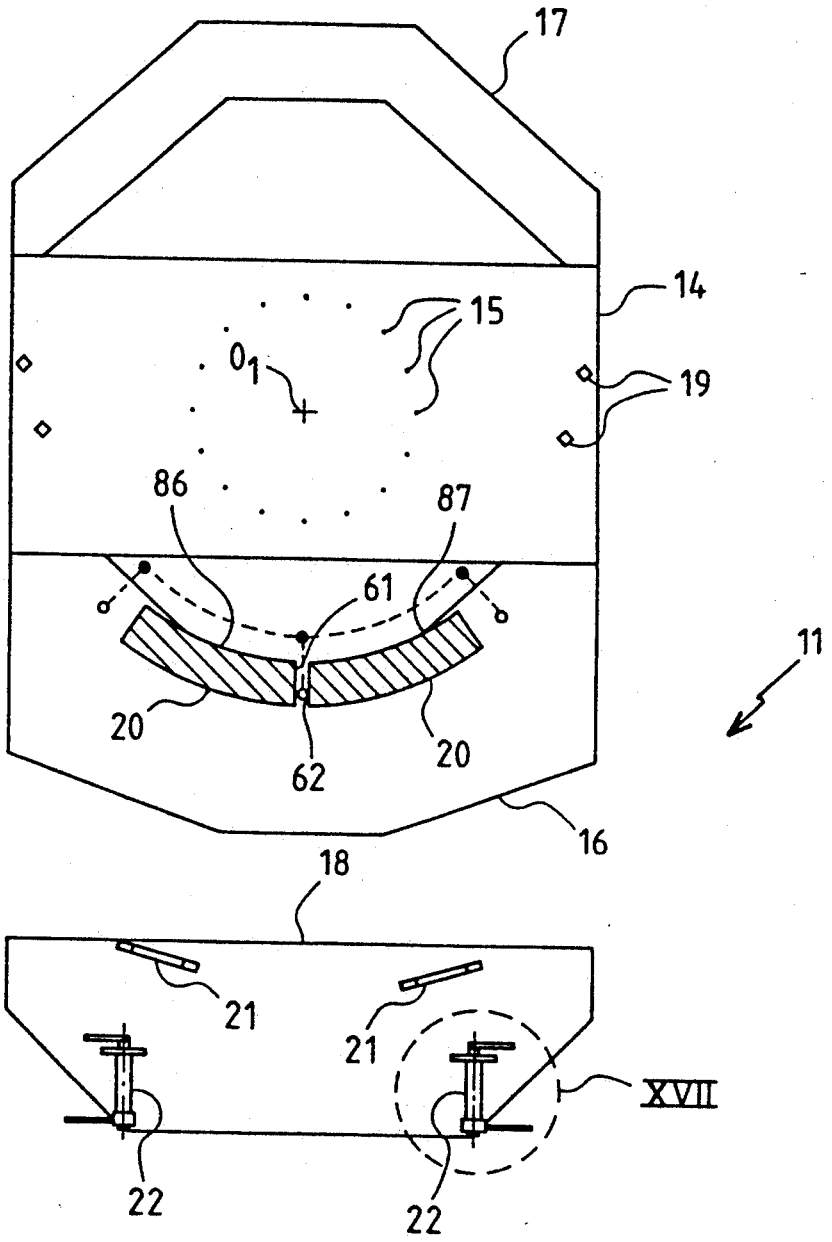
FIG. 4 is a detailed view showing the elements of the floor of the wagon which are designed for a single body.

In FIG. 3, where the bodies have been removed, the wagon 1 includes two central longitudinal beams 3 and 4, two lateral longitudinal beams 5 and 6, connecting crossbeams including the end crossbeams 7 and 8, buffers 9, wheels (which are not shown) adapted to roll on rails 10, and three identical floor regions 11, 12 and 13, of which one, with the reference number 11, is shown in detail in FIG. 4. These floor regions are fixed to the longitudinal beams 3 through 6.

The floor region 11 includes four plates: one transverse central plate 14 designed to receive a roller ring, which is not shown, for fixing with the aid of apertures 15 disposed in a circle, an inner roller plate 16, an outer roller plate 17 and an end plate 18.

On the central plate 14 upwardly projecting pins 19 are fixed for limiting the displacement in rotation of the body intended to be mounted on the floor. Two upwardly projecting curved bars 20 are fixed on the inner roller plate, centered on the axis $0_1$, the function of which will be explained hereinafter, and which are designed to guide a vertical finger, various possible positions of which are shown by the small black and white circles. Vertical plates 21 and supplementary stopping elements 22 are fixed on the end plate 18, the role of which will also be explained hereinafter.

Figure 5:
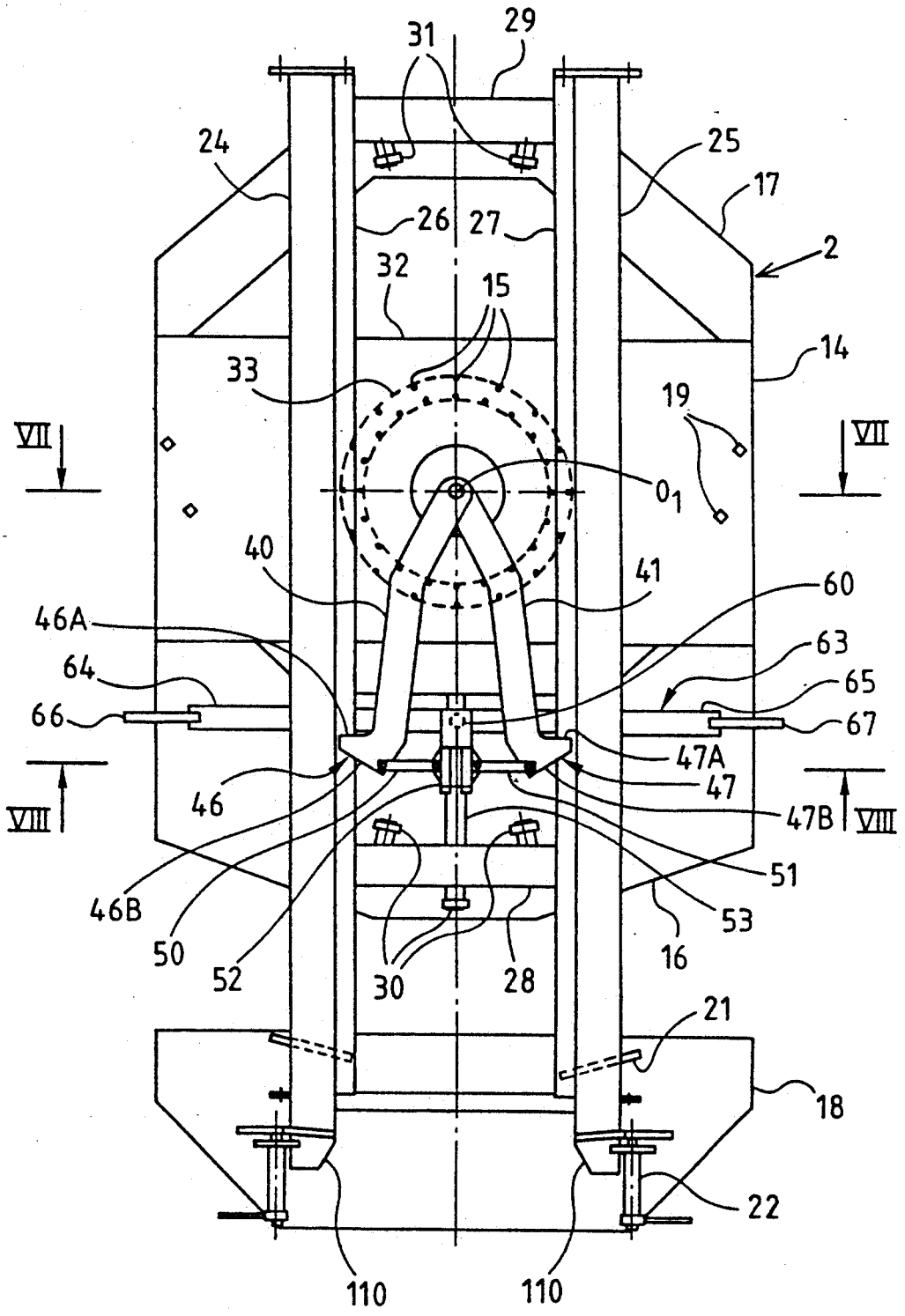
FIG. 5 is an analogous detailed view additionally illustrating a pivotable body and the locking means in accordance with the invention in the locking position.

FIG. 5 illustrates the floor region shown in FIG. 4 on which the body 2 and the locking means in accordance with the invention are mounted.

Figure 8:
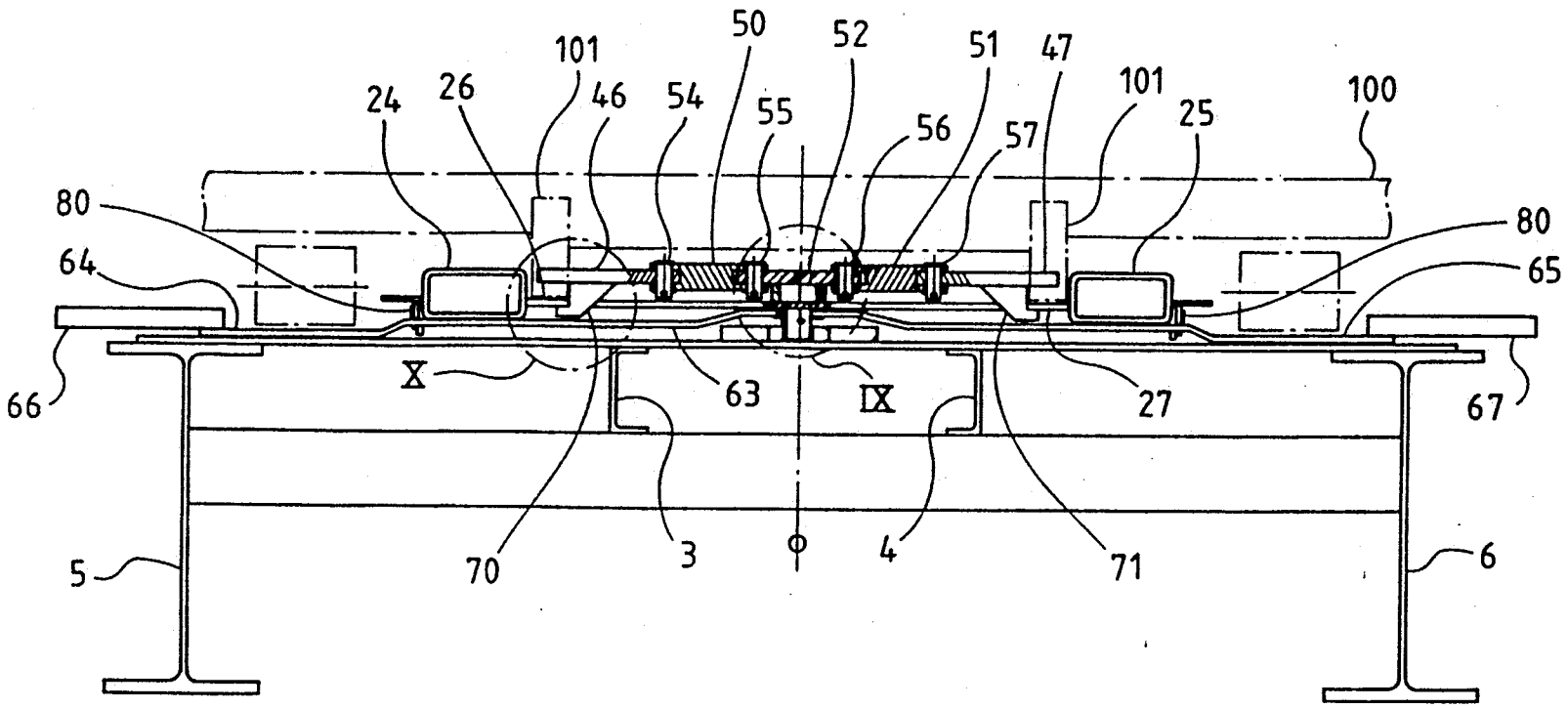
FIG. 8 is another view in transverse cross section taken along the line VIII—VIII in FIG. 5.

The body 2 principally includes two longitudinal beams 24 and 25 each bordered internally by a roller track 26 and 27 designed to receive the rear rollers of a lifting cradle 100 to be loaded and to support the longitudinal beams 101 of the latter (see FIG. 8). The longitudinal beams are joined together in particular by two crossbeams 28 and 29, each equipped with sets of rollers 30 and 31, disposed on either side of the articulation axis $0_1$ and designed to roll on the roller plates 16 and 17. In addition, this body has a plate 32 fixed to the longitudinal beams and to one of the tracks of a large circular bearing 33, for example a ball bearing, fixed by its other track to the plate 14 by means of the apertures 15.

Figure 7:
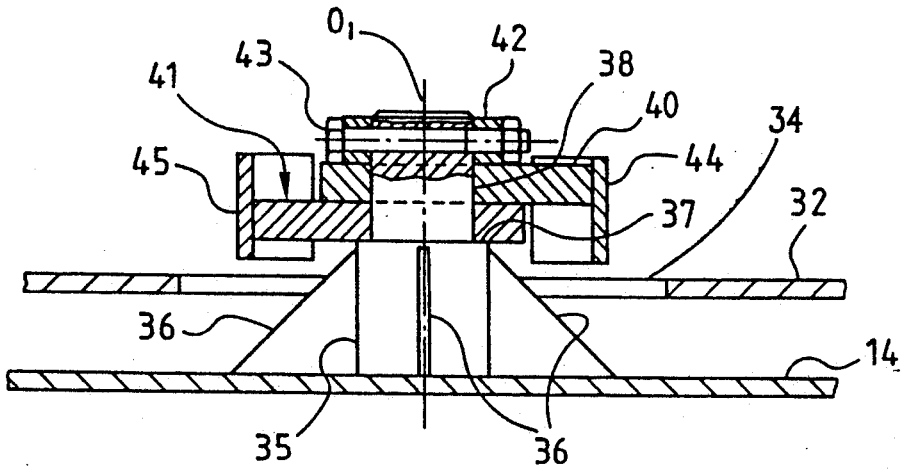
FIG. 7 is a view in transverse cross section taken along the line VII—VII in FIG. 5.

As best illustrated in FIG. 7, the plate 32 includes an aperture 34 having an axis coincident with the axis $0_1$ and through which a shaft 35 fixed to the plate 14 passes, to which plate it is also fixed by bracing plates 36.

The shaft has a shoulder 37 above the level of the plate 32 so as to form a narrowed section 38 on which the hole-containing ends of two locking arms 40 and 41 are fitted. These ends are maintained engaged on the narrowed section 38 by a ring 42 fixed by a transverse pin 43 (not shown in FIGS. 5 and 6). The arms 40 and 41 are flat and are bordered internally and externally by strengthening shoulder rims (of which only the external rims 44 and 45 can be seen in FIG. 7). The arms extend towards the end plate 18 and terminate in lateral projections such as hooks or noses 46 and 47 oriented in opposite horizontal directions to one another.

Figure 6:
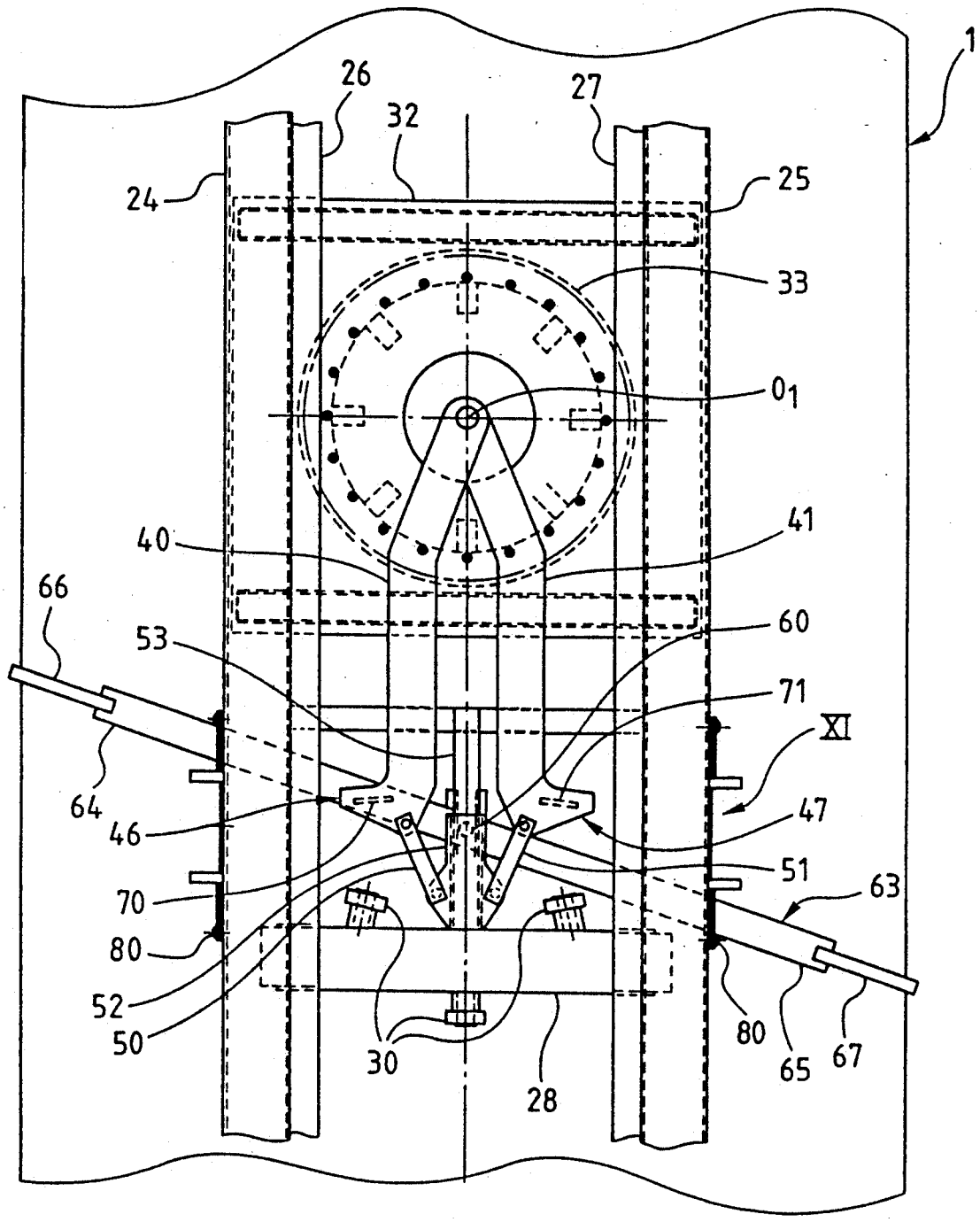
FIG. 6 is a view similar to FIG. 5 at a larger scale illustrating the unlocking configuration.

The arms allow a displacement in rotation about the shaft 35 (or about $0_1$) between the spread-out configuration shown in FIG. 5 and the configuration shown in FIG. 6 in which they are closer together. In the spread-out configuration the hooks penetrate into the space occupied by the longitudinal beams of a loaded lifting cradle (see FIG. 8). This is a locked configuration, whereas they remain outside this space in the closed configuration, which is an unlocked configuration.

In order to control their positions the arms are articulated near their noses or hooks by rods 50 and 51 which are also articulated on a common slide 52 mounted to slide on a guiding bar 53 fixed to the body, in this case fixed to the crossbeam 28. These rods are articulated about vertical axes by means of pins 54 to 57 shown in FIG. 8.

A guiding pin or finger 60 projects underneath the slide 52 and is engaged, with play, between two facing guide bearings 61 and 62 which are the facing cross-sections of the curved elements 20 shown in FIG. 4.

Figure 9:
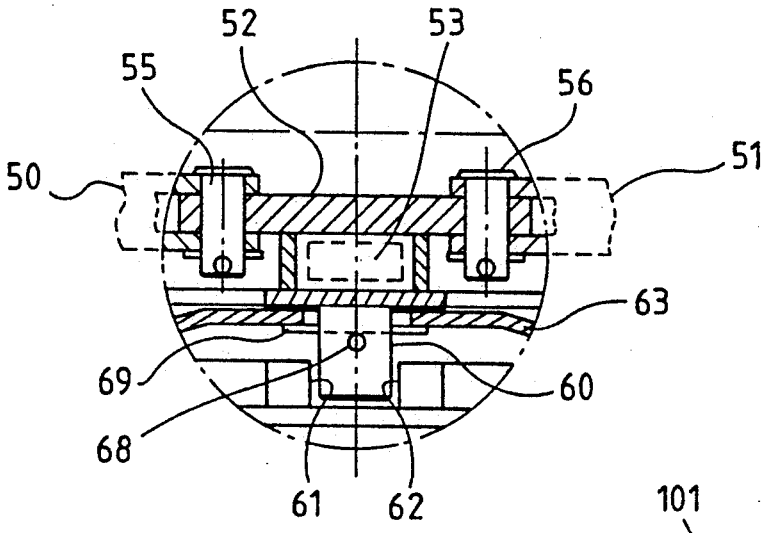
FIG. 9 is an enlarged view of the detail IX shown in FIG. 8.

A lever 63 is engaged on this guiding pin, the ends 64 and 65 of which project laterally beyond the body (see FIGS. 5, 6 and 8) and which are equipped with manipulating handles 66 and 67. The lever is held on the upper part of the guiding pin 60 by a pin 68 on which a retaining washer 69 bears, as best shown in FIG. 9.

Figure 10:
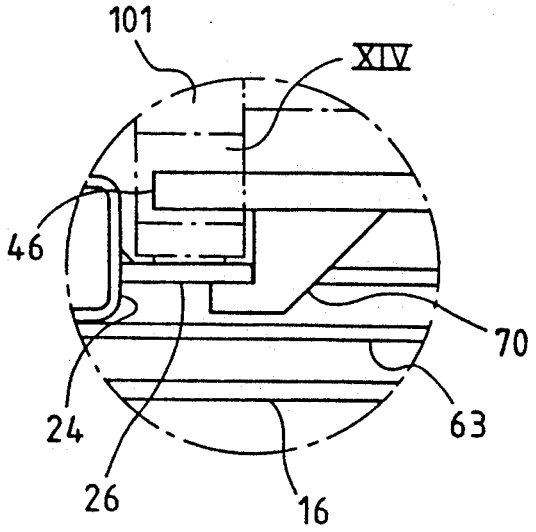
FIG. 10 is an enlarged view of the detail X shown in FIG. 8.

As can be seen clearly in FIGS. 6, 8 and 10, the arms include, beneath the aforementioned hooks, vertical hooks 70 and 71 for preventing lifting which are adapted to engage under the roller tracks 26 and 27.

Figures 11, 12, 13:
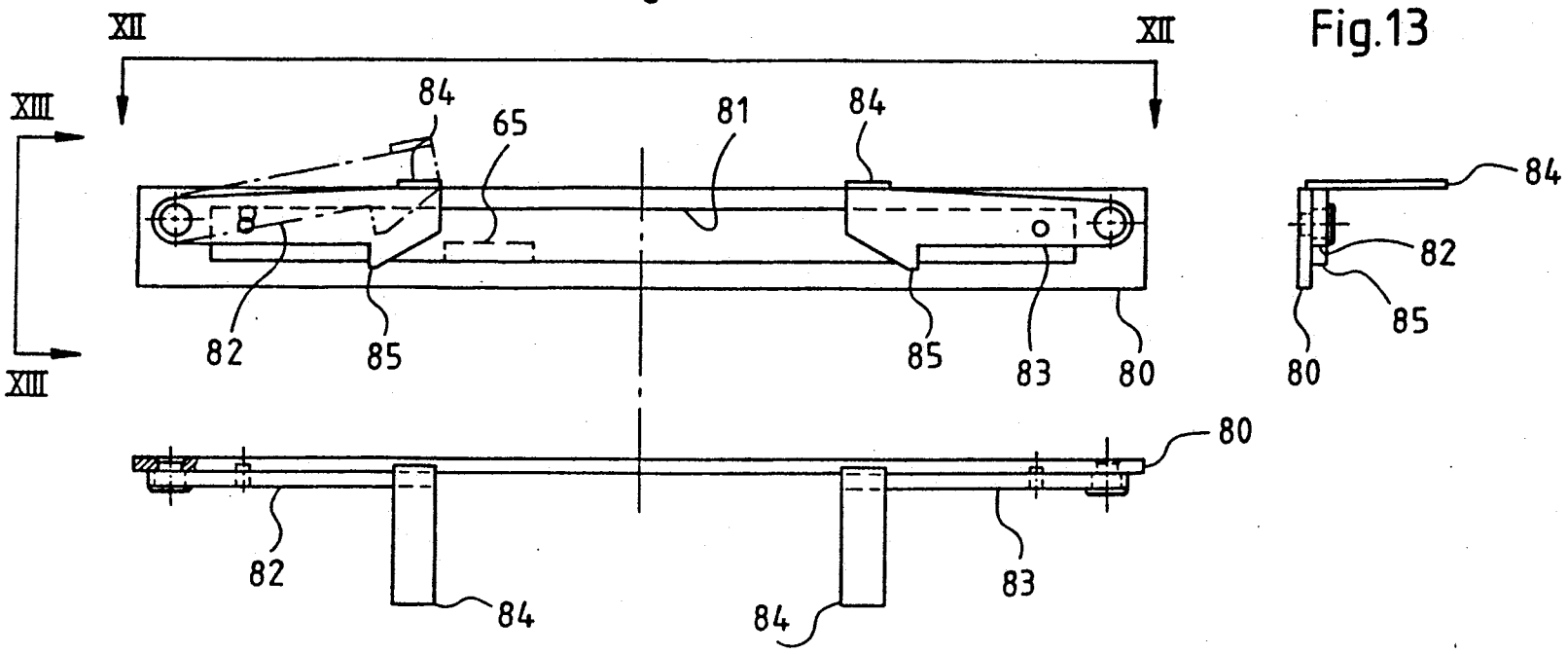
FIG. 11 is an enlarged view of the detail XI shown in FIG. 6.
FIG. 12 is an elevational view seen in the direction of the arrow XII in FIG. 11.
FIG. 13 is a view seen in the direction of arrow XIII in FIG. 11.

The ends 64 and 65 of the lever 63 are engaged in horizontal slots 81 in vertical plates 80 welded to the longitudinal beams of the body, details of which are shown in FIGS. 11 to 13.

On each plate 80, near the ends of the slots 81, hooks 82 and 83 are mounted facing towards one another and equipped with gripping handles 84, ends 85 of the hooks being adapted to force the hook to lift when the corresponding end of the lever is brought near one of the ends of the slot and to hold it there subsequently.

The plates 80 are positioned on the longitudinal beams of the body in such a manner that the ends of the lever are both at the ends (called internal or closing ends) of the slots 81 closest to the plate 32 connected to the ring bearing when in the configuration shown in FIG. 5, and the length of the slots is such that when one end of the lever remains in place while the other end of the lever moves along the slot in which it is engaged until it reaches the other end of the slot (opening end) the slide and the locking arms move into the configuration shown in FIG. 6.

In the configuration shown in FIG. 6 the guiding pin 60 is held laterally by the guide bearings 61 and 62 of the curved elements 20 shown in FIG. 4. The body cannot rotate about the axis $0_1$. This prevents, for safety reasons, it from being possible to maneuver the body when a lifting cradle has been placed on it without being locked to the wagon.

In a preferred manner the slide 52, when in the configuration shown in FIG. 6, bears against the crossbeam 28 of the body. This makes it possible to control the locking of a lifting cradle in the following manner. If on one side of the wagon (irrespective of the overall position of the lever) the lever is in the closing end of the slot and if this end of the lever can be moved into the other, opening end, this is because the other end of the lever was in the closing configuration and the locking means (arms, etc.) were originally in the locking configuration. A movement of this kind of the left end of the lever in FIG. 6 would in fact not be possible.

In the configuration shown in FIG. 5, the guiding pin 60 comes out of the groove between the guide bearings 61 and 62 and this makes it possible to pivot the body. During pivoting the concave sides 86 and 87 of the curved elements 20 shown in FIG. 4 prevent any unlocking and it is not until the guiding pin has ceased to move along these elements that unlocking becomes possible again (see the successive paths of the guiding pin shown in FIG. 4 where the white circles correspond to unlocking positions and the black circles to locking positions).

In the locking configuration the hooks 46 and 47 penetrate into housings made in the longitudinal beams of the lifting cradle 100.

Figure 14:
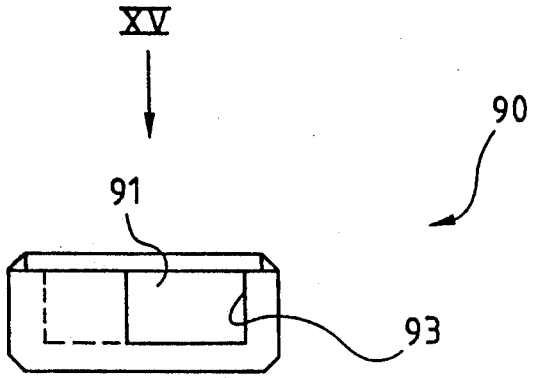
FIG. 14 is an enlarged view of the detail XIV shown in FIG. 10, seen from the left.
Figure 15:
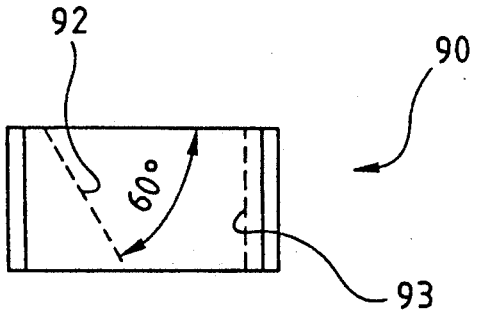
FIG. 15 is a view from above, seen in the direction of the arrow XV in FIG. 14.

FIGS. 14 and 15 show a block 90 adapted to be fixed in one, the one on the right (see FIG. 10), of the longitudinal beams of the body. The longitudinal beams conventionally have a C-shaped profile, the concavities of which face each other; a symmetrical block is to be fixed in the left longitudinal beam.

The block 90 includes a housing 91 having a transverse side 93 adapted to fit along the inside edge 46A and 47A of the corresponding hook and a side 92 inclined at 60° adapted to fit against the outside edge 46B and 47B of the hook.

It should be noted in this connection that the outside edge of the hooks is substantially transverse to a line joining the edge to the axis $0_1$, so as to allow it to penetrate with a small play in the housings 91, so that each hook comes to occupy substantially all the section of its housing (apart from a small appropriate play) with its edges facing the sides of the housing.

It will be appreciated that, in the locking configuration, the locking arms therefore take up (after taking up the aforementioned play if necessary) all the unwanted longitudinal forces which may be applied to the lifting cradle, in either direction, as well as, thanks to the vertical hooks or noses 70 and 71, any lifting forces. This applies whatever the length of the lifting cradle considered if the housings are provided at the correct locations.

It should be noted in this connection that in the locking configuration shown in FIG. 5 the rods are substantially aligned with one another which prevents, as a result of the bracing by these, rod, the hooks or noses from coming closer together when unwanted forces are applied. However, this arrangement is not essential.

It is important to note that this taking up of the forces is performed by elements (the arms) directly attached to the wagon, without acting on the pivotable body itself, and in particular without risk of damage of the ring bearing connecting the body to the wagon.

Figure 16:
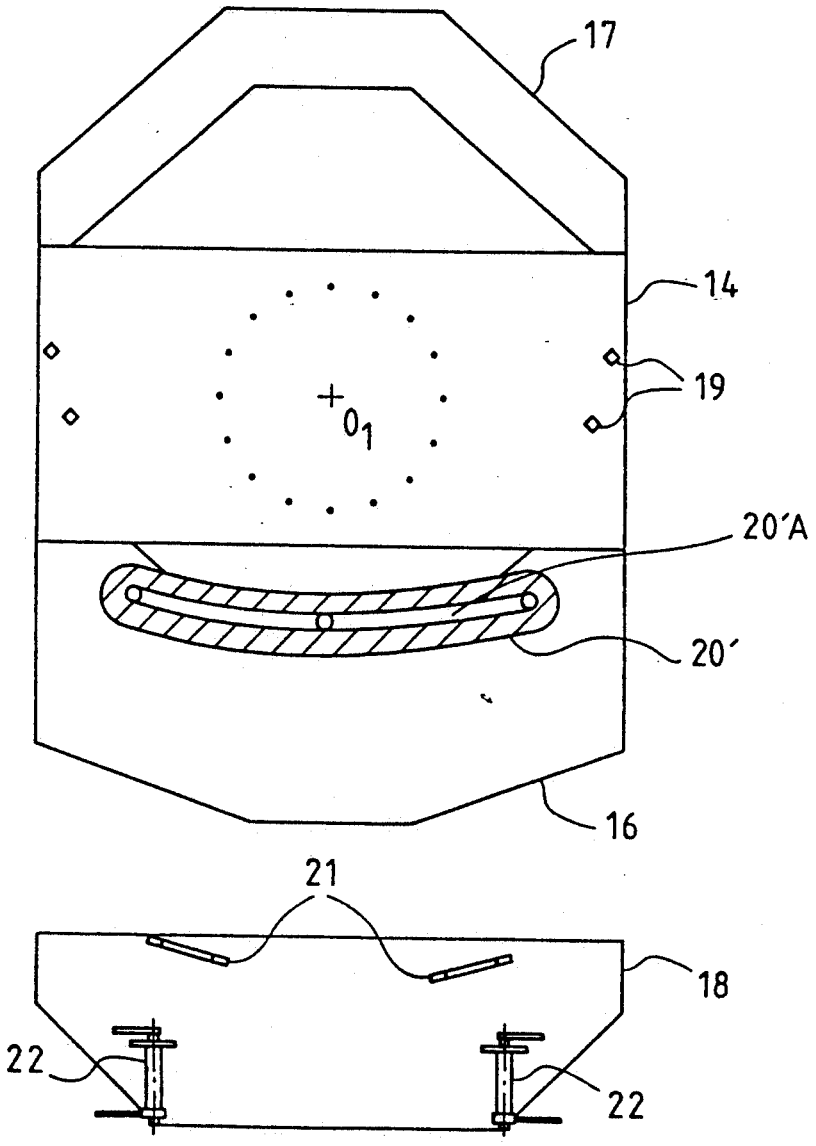
FIG. 16 is an alternative to the floor shown in FIG. 4, adapted to cause an automatic movement of the locking means.

FIG. 16 shows a variant of FIG. 4 in which the curved elements 20 are replaced by a single curved block 20' in which a curved groove 20'A is formed, all the other elements of the floor regions being otherwise identical. The groove, into which the guiding pin 60 penetrates, ensures automatic unlocking of a loaded lifting cradle gradually as the body is moved from a configuration aligned with the wagon (small black circles) towards a pivoted loading/unloading configuration (small white circles). The lever 63 is then not needed.

Figures 17, 18, 19:
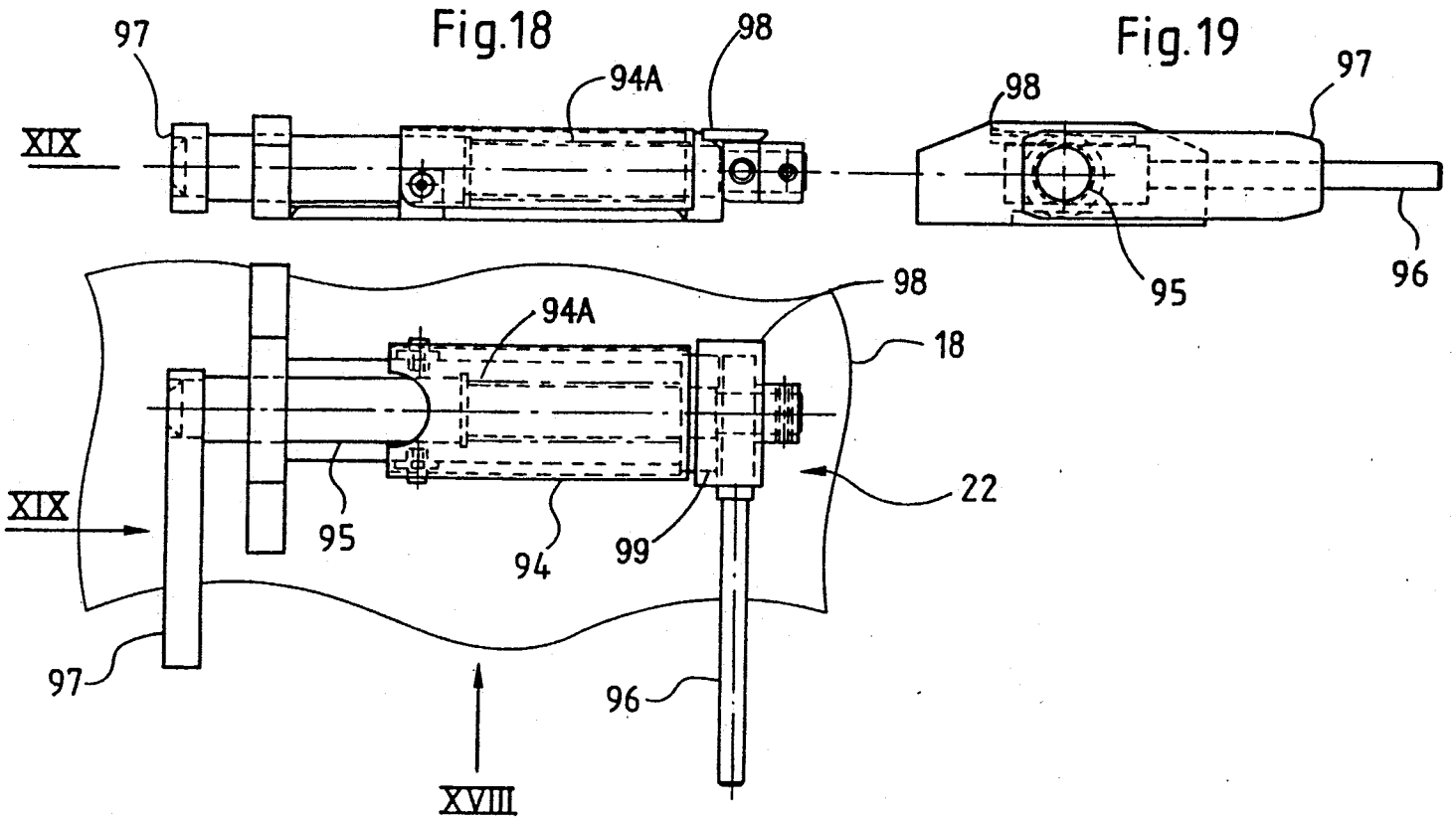
FIG. 17 is an enlarged view of the detail XVII shown in FIG. 4.
FIG. 18 is a side view seen in the direction of the arrow XVIII in FIG. 17.
FIG. 19 is an end view seen in the direction of the arrow XIX in FIGS. 17 and 18.

FIGS. 17 to 19 show in detail the supplementary stopping elements 22 shown in FIGS. 4 and 16.

Each supplementary element 22 includes a sleeve 94 fixed to the plate region 18 in which a bar 95 is engaged and at the ends of the bar a manipulating rod 96 and a tapered transverse lug 97 are attached. A small plate 98 passing along a prolongation 99 of the sleeve is fixed on the manipulating rod. A spring 94A disposed inside the sleeve around the bar tends to push this bar axially so as to move the lug away from the sleeve.

In the resting configuration shown in FIGS. 17 to 19 the lug 97 is at its maximum distance from the sleeve and extends along the plate 18.

The lug and the manipulating handle are turned laterally towards the outside of the wagon.

As can be seen in FIG. 5 the supplementary elements 22 are disposed so that the lugs 97 laterally enclose the ends of the longitudinal beams and thus completely prevent them from rotating.

In order to allow rotation of the body to one side of the wagon it suffices to pull on the manipulating rod of the supplementary element 22 situated on the side so as to bring the lug closer to the sleeve, thus freeing the longitudinal beam located on the same side. The manipulating rod is rotated up through several tens of degrees which causes the plate 98 to bear against the prolongation 99. On starting its rotation to the side the longitudinal beam, due to a horizontal plate 110 fixed to its end at a level above the height of the sleeve 94, automatically, by a cam effect on the upwardly rotated lug, causes the latter to be pushed down to the horizontal position and the supplementary element to return to its resting position in which it will again be able to block the body in rotation when it returns to its position of alignment with the wagon.

These supplementary elements 22 are therefore elements for locking the body in rotation.

The vertical plates 21 are bevels and are designed to act as supports for the overhanging ends of the longitudinal beams when the body is aligned with the wagon.

It goes without saying that the preceding description has been given solely by way of non-limiting example and that numerous modifications may be proposed by a person skilled in the art without departing from the scope of the invention.

What is claimed is:

1. A vehicle for carrying at least one support frame, said vehicle comprising:

a chassis;

at least one pivotable body mounted to said chassis so as to pivot relative to said chassis about a pivoting axis, each of said at least one pivotable body having support members for receiving one of said at least one support frame;

means mounted to said chassis for locking said one of said at least one support frame and said at least one pivotable body to said chassis, said locking means having first and second attachment arms pivotable about said pivoting axis between an unlocked configuration and a locked configuration, each said first and second attachment arm having a projection for engaging said one of said at least one support frame when in said locked configuration, for disengaging said one of said at least one support frame when in said unlocked configuration;

means mounted to said chassis for guiding the movement of said first and second attachment arms; and means mounted to said chassis for retaining said first and second attachment arms in said locked configuration.

2. A vehicle according to claim 1, further comprising lateral projections formed on said first and second attachment arms, said lateral projections being orientated to extend in opposite directions relative to one another, wherein said lateral projections engage said one of said at least one support frame when said first and second attachment arms are in said locked configuration.

3. A vehicle according to claim 1, further comprising a shaft disposed along said pivoting axis, and a roller ring mounted to said shaft and connecting said at least one pivotable body to said chassis, said first and second attachment arms being pivotable about said shaft.

4. A vehicle according to claim 1, wherein said pivoting axis is located near one end of each said at least one pivotable body and said first and second attachment arms extend from said pivoting axis towards an oppositely disposed end of each said at least one pivotable body.

5. A vehicle according to claim 1, wherein each of said first and second attachment arms comprises vertical projections for engaging each said at least one pivotable body in said locked configuration.

6. A vehicle according to claim 1, wherein said projections of said first and second attachment arms each comprise an inside edge adapted to be oriented, in said locked configuration, at approximately a right angle relative to an instantaneous longitudinal plane of symmetry of said first and second attachment arms, and an outside edge perpendicular to a line extending between said inside edge and said pivoting axis.

7. A vehicle according to claim 6, further comprising a pair of housings attached to said each of said at least one support frame, each housing of said pair of housings being engageable with one of said first and second attachement arms.

8. A vehicle according to claim 1, wherein said means for guiding the movement of said first and second attachment arms further comprises:

a guide attached to each said at least one pivotable body and disposed parallel to a longitudinal axis of each said at least one pivotable body;

a slide mounted to slide on said guide between two longitudinal positions;

means for pivotably attaching said slide to said first and second attachment arms; and means for controlling the movement of said slide on said guide.

9. A vehicle according to claim 8, wherein said attaching means comprises a pair of rods which are substantially aligned with one another when said first and second attachment arms are in said locked configuration.

10. A vehicle according to claim 8, wherein said means for controlling the movement of said slide comprises a lever pivotably mounted to said slide and extending transversely relative to each said at least one pivotable body.

11. A vehicle according to claim 10, further comprising two horizontal slots formed in each said at least one pivotable body for receiving said lever, each of said two horizontal slots having first and second ends and an arresting device for retaining said lever selectively in one of said first and second ends of each said two horizontal slots.

12. A vehicle according to claim 11, wherein said lever is in said first end of each said two horizontal slots when said first and second attachment arms are in said locked configuration.

13. A vehicle according to claim 11, wherein said lever is in said second end of one of said two horizontal slots, when said first and second attachment arms are in said unlocked configuration and said slide bears against each said at least one pivotable body.

14. A vehicle according to claim 13, further comprising a stop formed on each said at least one pivotable body against which said slide bears, and wherein said stop comprises a crossbeam attached to each said at least one pivotable body.

15. A vehicle according to claim 10, further comprising:

a vertical finger extending from said slide; and two facing guide bearings attached to said chassis and extending parallel to a longitudinal plane of symmetry containing said pivoting axis, said vertical finger projecting between said two facing guide bearings.

16. A vehicle according to claim 15, wherein said two facing guide bearings comprise two curved elements mounted on said chassis, each of said two curved elements having concave surfaces for guiding said vertical finger in a rotational path centered on said pivoting axis.

17. A vehicle according to claim 8, wherein said controlling means comprises a vertical finger projecting downwards from said guide, and wherein said chassis has an arcuate groove extending to either side of a longitudinal plane of symmetry through said pivoting axis, said arcuate groove having a median portion and an oppositely disposed pair of end portions, said median portion being closer to said pivoting axis than said pair of end portions, wherein said first and second attachment arms are in said locked configuration when said vertical finger is in said median portion, and wherein said first and second attachment arms are in said unlocked configuration when said vertical finger is in one of said pair of end portions, such that said first and second attachment arms move between said locked and unlocked configurations when each said at least one pivotable body pivots relative to said chassis.

18. A vehicle according to claim 1, wherein each said at least one pivotable body has roller elements, said first and second attachment arms being disposed between said pivoting axis and said roller elements, said roller elements supporting each said at least one pivotable body on said chassis.

19. A vehicle according to claim 1, wherein said chassis has means for preventing rotation of each said at least one pivotable body.

20. A vehicle according to claim 1, wherein said chassis supports a plurality of said pivotable bodies.

21. A lifting cradle for loading on a vehicle having a chassis, a pivotable body mounted to said chassis so as to pivot relative to said chassis about a pivoting axis, a pair of attachment arms pivotable about said pivoting axis between an unlocked configuration and a locked configuration, said pair of attachment arms locking said lifting cradle to said chassis when in said locked configuration, projections extending from each arm of said pair of attachment arms, means mounted to said chassis for guiding the movement of said pair of attachment arms, and means mounted to said chassis for retaining said pair of attachment arms in said locked configuration, wherein said lifting cradle comprises:

elongate members; and housings attached to said elongate members for receiving each of said projections of said pair of attachment arms.

* * * * *

UNITED STATES PATENT AND TRADEMARK OFFICE

CERTIFICATE OF CORRECTION

PATENT NO. : 5,281,072

DATED : January 25, 1994

INVENTOR(S) : Jean Baptiste Patouillard, Paul Fanget and Jean-Louis Chevalier

It is certified that error appears in the above-identified patent and that said Letters Patent is hereby corrected as shown below:

Column 5, line 5, after "2" insert ---- can ----.

Column 7, line 45, delete ", rod," insert ---- rods, ----.

Signed and Sealed this

Fourteenth Day of June, 1994

Bruce Lehman

*Attest:*

BRUCE LEHMAN

*Attesting Officer*

*Commissioner of Patents and Trademarks*